US007296984B2

(12) United States Patent
Iwasaki

(10) Patent No.: US 7,296,984 B2
(45) Date of Patent: Nov. 20, 2007

(54) GEAR PUMP AND LIQUID INJECTION APPARATUS

(75) Inventor: Mitsutaka Iwasaki, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 329 days.

(21) Appl. No.: 11/002,232

(22) Filed: Dec. 3, 2004

(65) Prior Publication Data

US 2005/0196301 A1 Sep. 8, 2005

(30) Foreign Application Priority Data

Dec. 3, 2003 (JP) ..... 2003-404975

(51) Int. Cl.
*F04C 2/18* (2006.01)

(52) U.S. Cl. ..... 418/133; 418/206.6; 418/149

(58) Field of Classification Search ..... 418/206.1, 418/206.7, 206.6, 149, 132, 133
See application file for complete search history.

(56) References Cited

U.S. PATENT DOCUMENTS 1,694,805 A * 12/1928 Wiltse ..... 418/133
3,101,673 A * 8/1963 Clark et al. ..... 418/132
3,247,999 A * 4/1966 Stilwell ..... 383/127
RE29,456 E * 10/1977 Drutchas et al. ..... 417/53
4,380,770 A * 4/1983 Maruyama ..... 347/29
4,465,444 A * 8/1984 Dworak et al. ..... 418/132
6,183,231 B1 * 2/2001 Van Norman ..... 418/206.6
6,527,529 B2 * 3/2003 Bodzak et al. ..... 418/206.6
6,655,913 B2 * 12/2003 Vedantam et al. ..... 415/214.1

FOREIGN PATENT DOCUMENTS

JP 60-83074 U 6/1985
JP 2-90377 U 7/1990
JP 2-144684 U 12/1990
JP 8-093657 A 4/1996

* cited by examiner

*Primary Examiner*—Thomas Denion
*Assistant Examiner*—Mary A Davis
(74) *Attorney, Agent, or Firm*—Sughrue Mion, PLLC

(57) ABSTRACT

A gear pump includes a housing defining an accommodating chamber and a cover for sealing the accommodating chamber. The accommodating chamber accommodates a drive gear and a driven gear. Each of the drive gear and the driven gear includes an upper surface opposed to the cover and a lower surface opposed to the housing. An annular projection projects from the upper surface of the drive gear or the driven gear for contacting the seal plate. An annular projection projects from the lower surface of the drive gear or the driven gear for contacting the seal plate. The gear pump is capable of lowering the load when the drive gear and the driven gear are rotated.

8 Claims, 8 Drawing Sheets

GEAR PUMP AND LIQUID INJECTION APPARATUS

BACKGROUND OF THE INVENTION

The present invention relates to gear pumps and liquid ejection apparatuses employing such gear pumps.

Conventionally, gear pumps are configured relatively simply and thus advantageous with respect to other types of pumps. As such gear pumps, for example, the gear pump 100 of FIG. 11 is known. The gear pump 100 includes a housing 101 in which an accommodating chamber 102 is defined for accommodating a drive gear 103 and a driven gear 104. An opening for the accommodating chamber 102 in the housing 101 is sealed by a non-illustrated seal plate. The upper surfaces of the drive gear 103 and the driven gear 104 are held in contact with the seal plate in a slidable manner. If the drive gear 103 is rotated through rotation of a drive shaft 105, the driven gear 104 is rotated as driven by the drive gear 103. In this state, the liquid retained in the suction chamber 110 defined in the accommodating chamber 102 is moved to the space defined by each gear groove of the gears 103, 104 and the inner walls of the accommodating chamber 102. The liquid is eventually discharged into a discharge chamber 112. The liquid is continuously introduced into the discharge chamber 112, which is defined in the accommodating chamber 102, through rotation of the gears 103, 104. The pressure in the discharge chamber 112 thus becomes higher than the pressure in the suction chamber 110.

If the gap between the gears 103, 104 and the seal plate is relatively large, the liquid leaks through the gap and is recirculated from the discharge chamber 112 under relatively high pressure to the suction chamber 110 under relatively low pressure. It is thus necessary to minimize the gap between the gears 103, 104 and the seal plate. To meet this need, a gear pump in which a plate spring is deployed between the bottom surface of the accommodating chamber 102 and the gears 103, 103 has been proposed (as described in, for example, Japanese Laid-Open Patent Publication No. 8-093657). The plate spring urges each of the gears 103, 104 toward the seal plate or the housing.

However, if the gears are pressed by the plate spring against the seal plate, relatively great friction torque or viscous load torque is produced when the gears slide along the seal plate or the housing. This causes a relatively great load to act on the drive source of the gear pump 100, which is a problem.

SUMMARY OF THE INVENTION

Accordingly, it is an objective of the present invention to provide a gear pump and a liquid ejection apparatus capable of reducing load when a gear is rotated.

To achieve the foregoing objectives, an aspect of the present invention is a gear pump. The gear pump includes a housing defining an accommodating chamber and a seal plate for sealing the accommodating chamber. A drive gear and a driven gear are received in the accommodating chamber. Each of the drive and driven gears has a side surface opposed to the seal plate, and a projection projects from the side surface of the drive gear or the driven gear for contacting the seal plate.

Another aspect of the present invention is also a gear pump. The gear pump includes a housing defining an accommodating chamber and a seal plate for sealing the accommodating chamber. A drive gear and a driven gear are received in the accommodating chamber. Each of the drive and driven gears has a side surface opposed to the housing, and a projection projects from the side surface of the drive gear or the driven gear for contacting the housing.

Another aspect of the present invention is also a gear pump. The gear pump includes a housing defining an accommodating chamber and a seal plate for sealing the accommodating chamber. The seal plate includes a first side surface and a second side surface. A drive gear and a driven gear are received in the accommodating chamber. A first urging member is formed at the first side surface of the seal plate for urging the seal plate toward the housing. A second urging member is deployed between the seal plate and the housing for urging the seal plate in a direction opposed to the urging direction of the first urging member by an urging force smaller than the urging force of the first urging member.

Another aspect of the present invention is a liquid ejection apparatus. The liquid ejection apparatus is provided with any one of the above-described gear pumps.

Other aspects and advantages of the invention will become apparent from the following description, taken in conjunction with the accompanying drawings, illustrating by way of example the principles of the invention.

BRIEF DESCRIPTION OF THE DRAWINGS

The characteristics of the present invention that are believed to be novel will be made clear particularly by the attached claims. The invention, together with objects and advantages thereof, may best be understood by reference to the following description of the presently preferred embodiments together with the accompanying drawings in which:

DETAILED DESCRIPTION OF THE PREFERRED EMBODIMENTS

An embodiment of the present invention will hereafter be described with reference to FIGS. 1 to 9.

Figure 1:
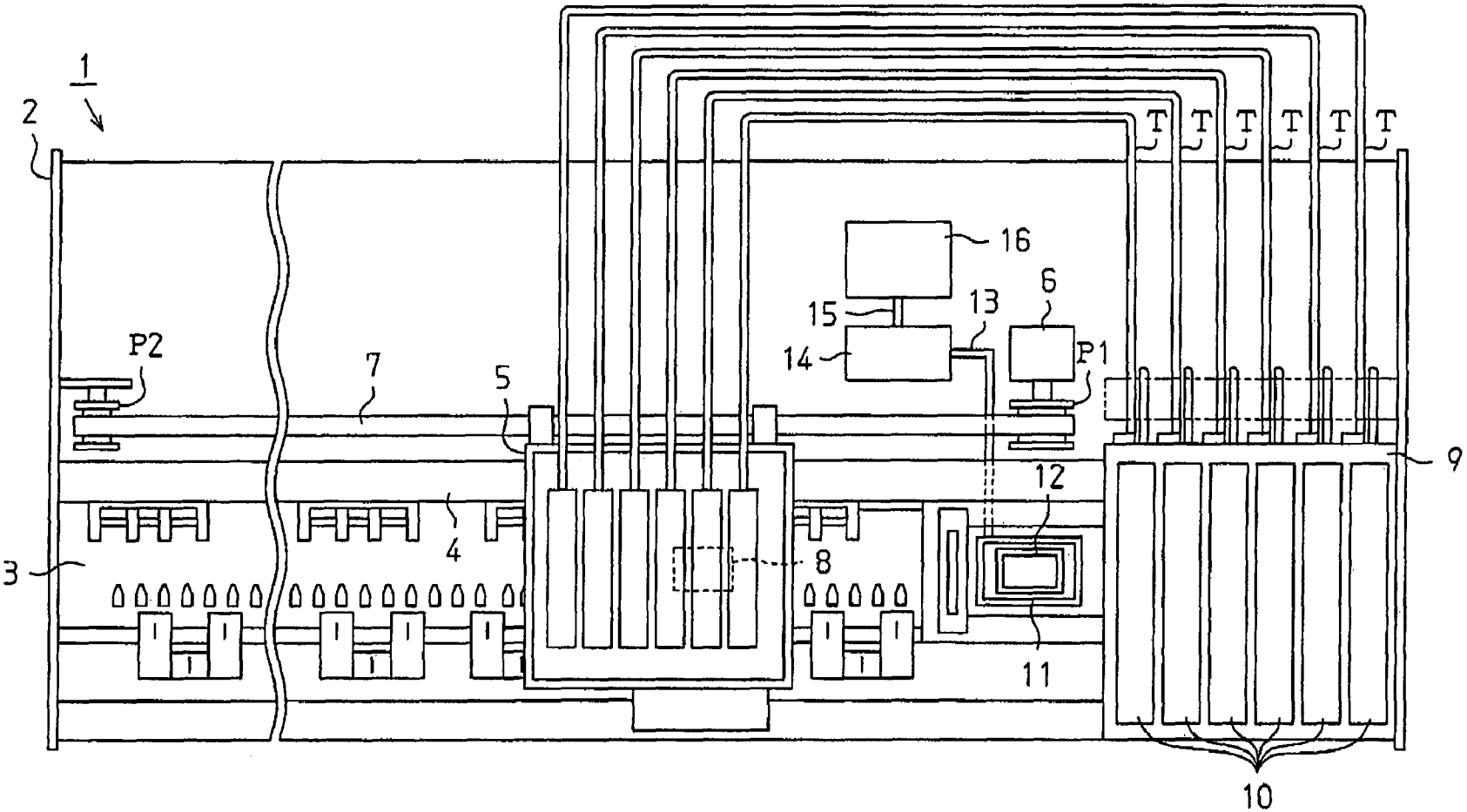
FIG. 1 is a plan view showing a printer according to an embodiment of the present invention.

As shown in FIG. 1, a printer 1, or a liquid ejection apparatus according to the illustrated embodiment, includes a substantially rectangular parallelepiped frame 2. A platen 3 is provided in the frame 2, and recording paper (not shown) serving as a target is fed to the platen 3 by a non-illustrated paper feeder mechanism.

A guide member 4 is provided in the frame 2, extending parallel with the longitudinal direction of the platen 3. The guide member 4 is passed through a carriage 5 such that the carriage 5 is movable along the guide member 4. A carriage motor 6 is secured to the frame 2 and drives the carriage 5 through a timing belt 7 held by a pair of pulleys P1, P2. In this manner, when the carriage motor 6 is actuated, the drive force of the carriage motor 6 is transmitted to the carriage 5 through the timing belt 7. The carriage 5 is thus moved reciprocally and parallel with the longitudinal direction of the platen 3 as supported by the guide member 4.

At the lower surface of the carriage 5 (the surface opposed to the platen 3), a recording head 8 serving as a liquid ejection head is formed. Although not illustrated, the recording head 8 includes a nozzle forming surface defined at the lower surface of the recording head 8 opposed to the platen 3.

Also, referring to FIG. 1, the frame 2 includes a cartridge case 9. Ink cartridges 10 each serving as a liquid retaining portion are installed in the cartridge case 9. The number of the ink cartridges 10 is six in the illustrated embodiment, and each of the ink cartridges 10 retains ink. The ink in each ink cartridge 10 is pressurized by a non-illustrated pressurizing pump and thus fed to the recording head 8 through a corresponding one of tubes T.

The ink is then pressurized by a non-illustrated piezoelectric element formed in the recording head 8. The ink is thus ejected to the recording paper through a nozzle of the recording head 8, as an ink drop.

In a non-printing area of the frame 2, as viewed to the right in FIG. 1, a cap member 12 is provided for sealing the nozzle of the recording head 8 when the printer 1 is in a non-printing state. The cap member 12 is formed of elastic material and in a box-like shape. The cap member 12 is supported by a cap holder 11 such that the opening of the cap member 12 faces the nozzle forming surface of the recording head 8. The cap holder 11 is actuated by a non-illustrated actuation mechanism and operates to place the cap member 12 in close contact with the nozzle forming surface for preventing dryness in the vicinity of the nozzle opening.

A suction hole (not shown) is defined in the cap holder 11 such that the interior of the cap member 12 is communicated with the exterior through the suction hole. The proximal end of the tube 13 is connected to the suction hole. The distal end of the tube 13 is connected to a pump unit 14 provided in the frame 2. A waste ink reservoir 16 is connected to the pump unit 14 through a tube 15. If the pump unit 14 is actuated with the nozzle forming surface sealed by the cap member 12, negative pressure is generated in the space defined by the cap member 12 and the nozzle forming surface. The highly viscous ink and air bubbles in the nozzle of the recording head 8 or the ink or dust adhered to the nozzle forming surface are thus drawn to be removed such that the recording head 8 is cleaned. The ink and the like removed from the recording head 8 is recovered in the waste ink reservoir 16 through the pump unit 14.

Figure 2:
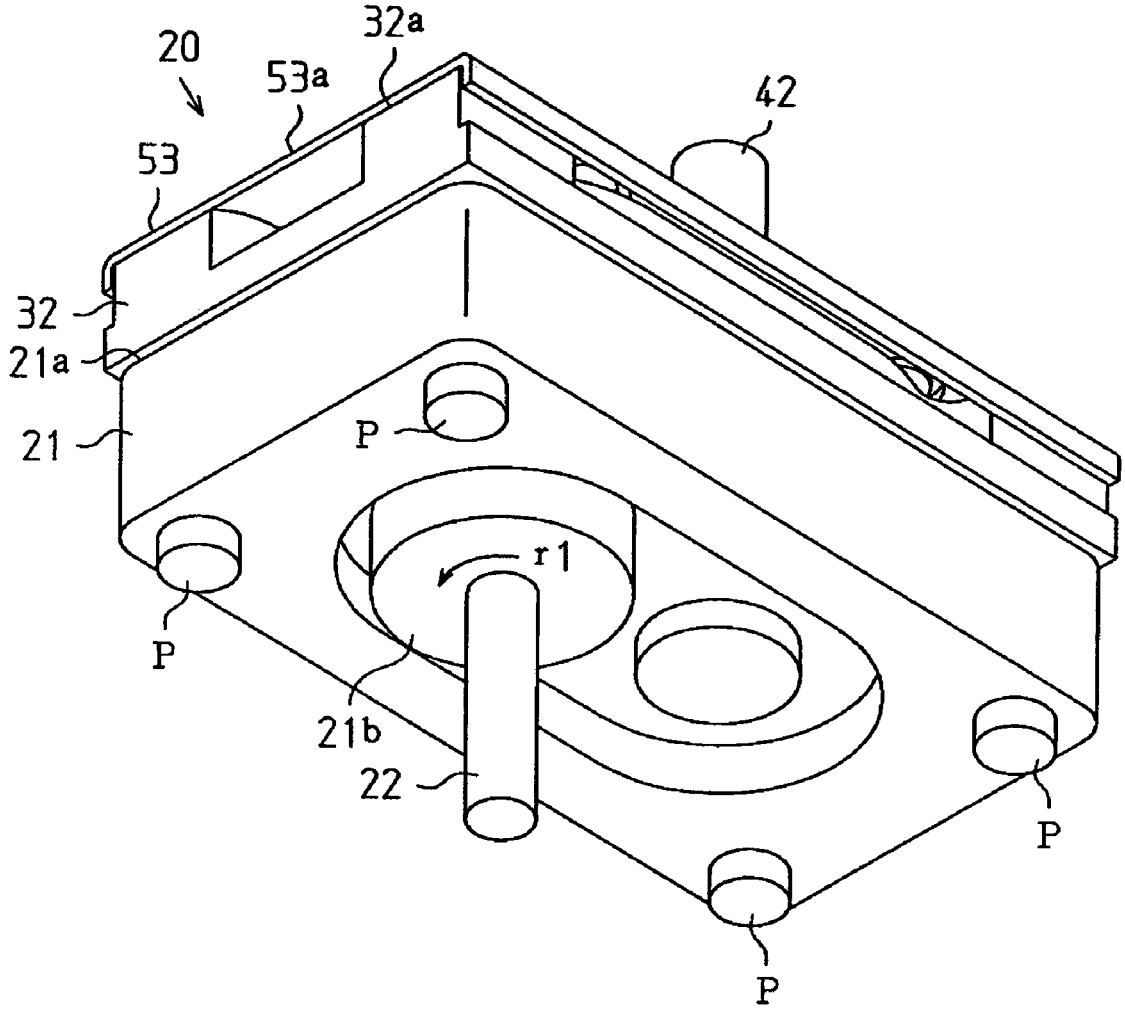
FIG. 2 is a perspective view showing a gear pump provided in the printer of FIG. 1.

The pump unit 14 includes a non-illustrated drive motor, a non-illustrated drive mechanism, and a gear pump 20 (see FIG. 2). When the drive motor is actuated, the gear pump 20 is actuated through the drive mechanism.

The gear pump 20 of the pump unit 14 will now be explained with reference to FIGS. 2 to 9.

As shown in FIG. 2, the gear pump 20 includes a housing 21. A bearing portion 21*b* is formed in an outer side surface of the housing 21. A drive shaft 22 projects from the bearing portion 21*b* and is rotatably supported by the bearing portion 21*b*. The drive shaft 22 is connected to the drive mechanism and rotated through actuation of the drive motor. In this manner, the drive shaft 22 rotates a drive gear 26 (see FIG. 3) received in the housing 21.

Figure 3:
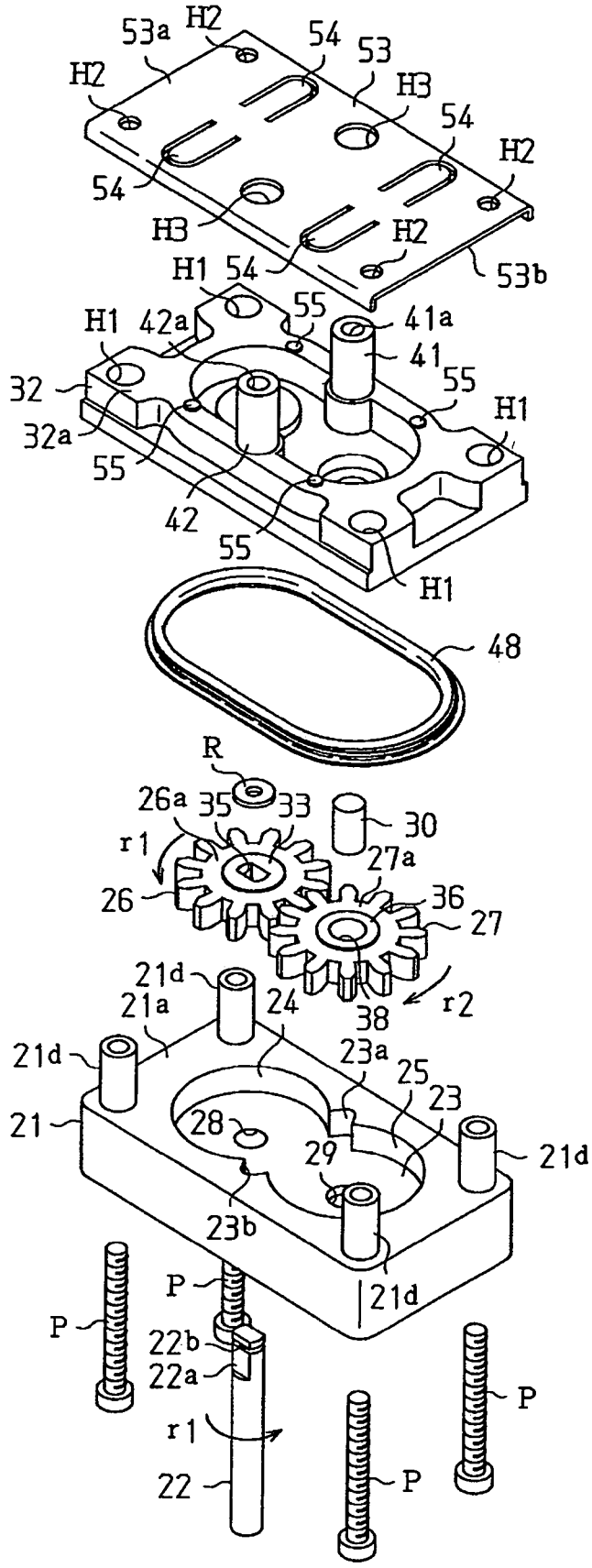
FIGS. 3 and 4 are exploded perspective views showing the gear pump of FIG. 2.

Referring to FIG. 3, the housing 21 is formed in a substantially rectangular parallelepiped shape. An accommodating chamber 23 is defined in a side surface 21*a* of the housing 21. The accommodating chamber 23 includes a first accommodating portion 24 and a second accommodating portion 25. Each of the first and second accommodating portions 24, 25 has a shape capable of receiving a substantially columnar component. The first and second accommodating portions 24, 25 are connected to each other. In the side surface 21*a* of the accommodating chamber 23, a suction portion 23*a* and a discharge portion 23*b* are defined between the first accommodating portion 24 and the second accommodating portion 25.

As illustrated in FIG. 3, a shaft hole 28 with a substantially circular shape is defined in the bottom surface of the first accommodating portion 24 and extends through the bearing portion 21*b*. The drive shaft 22 is rotatably supported by the shaft hole 28. A shaft support portion 29 is formed in the bottom surface of the second accommodating portion 25. The shaft support portion 29 forms a recess for supporting an end of a driven shaft 30 of a driven gear 27, which will be later described.

Cylindrical bolt passing portions 21*d* are formed at the four corners of the side surface 21*a* of the housing 21. Each of the bolt passing portions 21*d* receives a bolt P, as will be discussed later.

Figure 4:
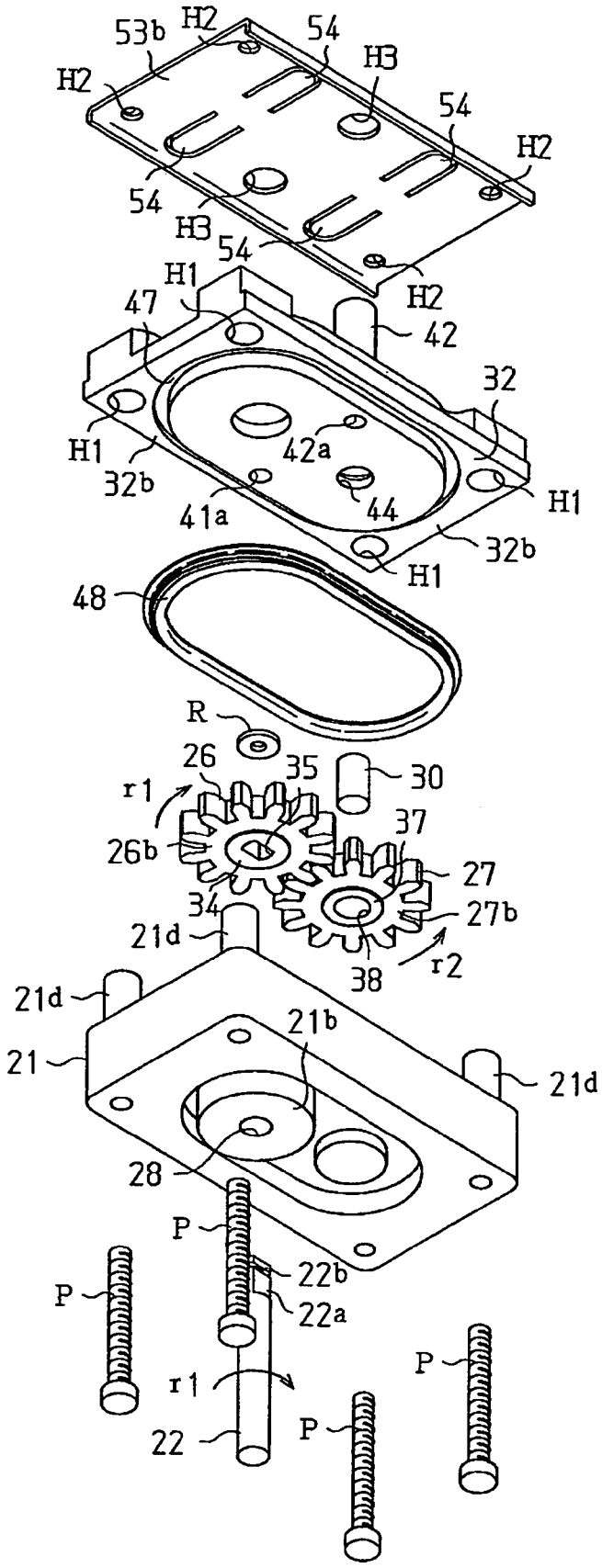
Figure 6:
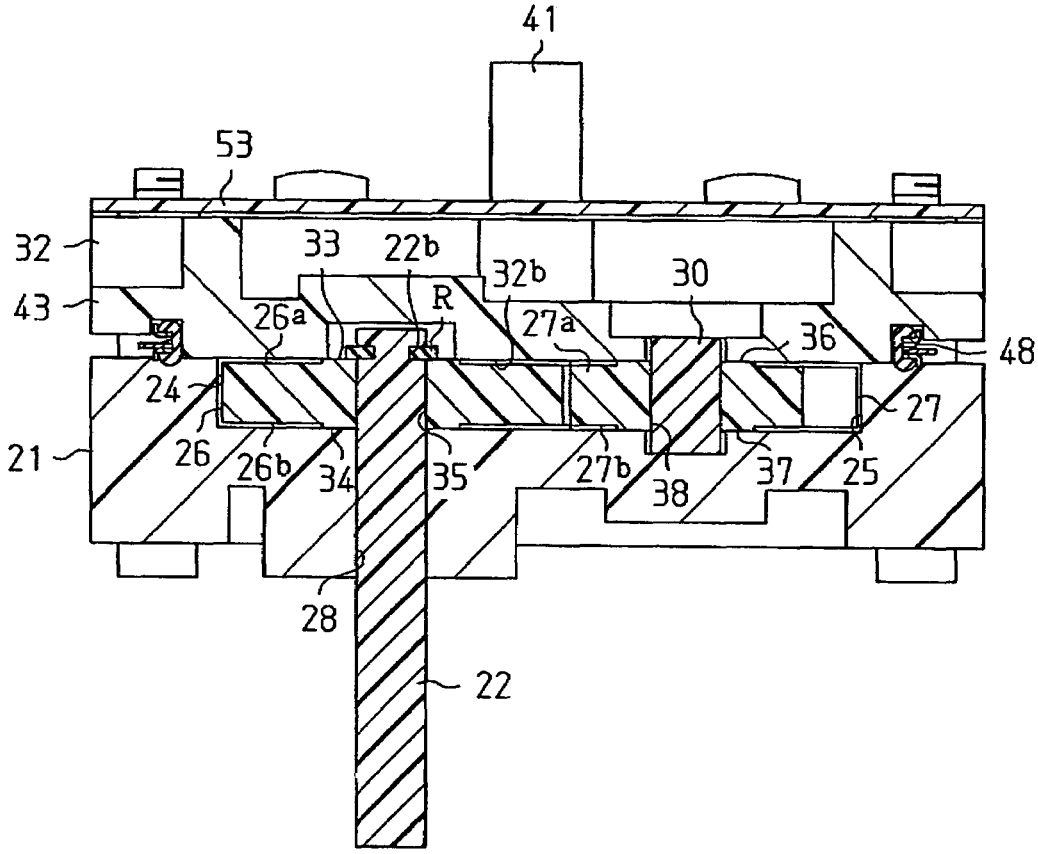
FIG. 6 is a longitudinal cross-sectional view showing the printer of FIG. 2.

Next, the drive gear 26 and the driven gear 27 will be explained. With reference to FIGS. 3 and 4, an annular projection 33 and an annular projection 34 project respectively from an upper surface 26*a* and from a lower surface 26*b* of the drive gear 26. The height of each projection 33, 34 is not more than 50 μm. A shaft hole 35 extends through the substantial middle of each projection 33, 34. The shaft hole 35 receives the drive shaft 22, which is passed through the shaft hole 28 of the housing 21. As shown in FIG. 6, a groove 22*b* is defined in a distal end of the drive shaft 22 projecting from the shaft hole 35 of the drive gear 26. A seal ring R (see FIG. 3) is fitted into the groove 22*b*. This structure connects the drive shaft 22 to the drive gear 26 in an inseparable manner.

Like the drive gear 26, the driven gear 27 includes an annular projection 36 and an annular projection 37 projecting respectively from an upper surface 27*a* and from a lower surface 27*b*. The height of each of the projections 36, 37 is not more than 50 μm. A shaft hole 38 extends through the substantial middle of the annular projections 36, 37. A substantially columnar driven shaft 30, which is supported by the shaft support 29 of the housing 21, is passed through the shaft hole 38. The driven gear 27 is rotatably supported by the driven shaft 30.

Figure 5:
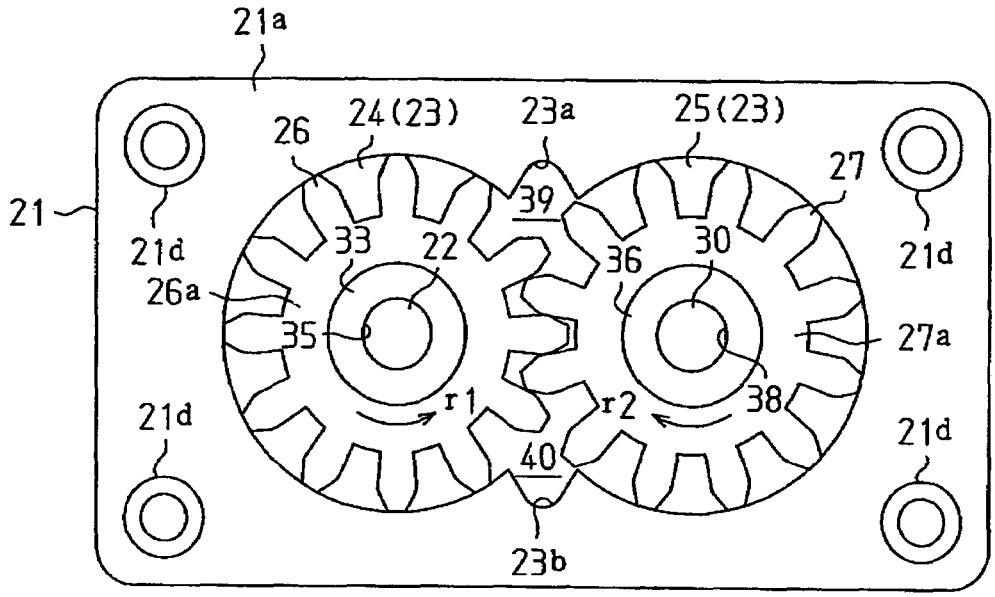
FIG. 5 is a plan view showing the gear pump of FIG. 2.

As shown in FIG. 5, the drive gear 26 and the driven gear 27 are received respectively in the first accommodating portion 24 and in the second accommodating portion 25, as meshed with each other. In the accommodating chamber 23, the drive gear 26 and the driven gear 27 define a suction chamber 39 and a discharge chamber 40. The suction chamber 39 and the discharge chamber 40 are arranged such that the meshed portion of the drive and driven gears 26, 27 is located between the suction chamber 39 and the discharge chamber 40. A section of the suction chamber 39 is configured by the suction portion 23*a* and a section of the discharge chamber 40 is configured by the discharge portion 23*b*. The suction chamber 39 temporarily retains the ink introduced from the exterior through a suction port 41, which will be later described. When the drive gear 26 and the driven gear 27 are rotated respectively in the direction r1 and in the direction r2 of FIG. 5, the ink in the suction chamber 39 is sent to the space defined by the inner walls of the accommodating chamber 23 and the grooves of the drive or driven gear 26, 27. The ink is eventually discharged to the discharge chamber 40. The pressure in the discharge chamber 40 is thus higher than the pressure in the suction chamber 39.

Hereafter, a cover 32 functioning as a seal plate for sealing the accommodating chamber 23 of the housing 21 will be explained. Referring to FIG. 2, the cover 32 is disposed on the side surface 21*a* of the housing 21 such that the cover 32 seals the opening of the accommodating chamber 23. As shown in FIG. 3, the cover 32 includes the suction port 41 and a discharge port 42 each having a cylindrical shape, projecting from an upper surface (a first side surface) 32*a* of the cover 32. A central opening 41*a* defined by the suction port 41 and a central opening 42*a* defined by the discharge port 42 have openings at a lower surface (a second side surface) 32*b* of the cover 32 opposed to the upper surface 32*a*, as illustrated in FIG. 4. In this manner, the central opening 41*a* and the central opening 42*a* correspond respectively to the suction chamber 39 and to the discharge chamber 40, when the cover 32 is attached to the housing 21.

A distal end of the tube 13 extending from the cap member 12 is connected to the suction port 41. The ink in the cap member 12 is thus sent to the suction chamber 39 defined in the gear pump 20 through the suction port 41. The tube 15 extending from the waste ink reservoir 16 is connected to the discharge port 42. The ink in the discharge chamber 40 is thus introduced to the waste ink reservoir 16 through the tube 15. As shown in FIG. 3, four circular projections 55 project from the upper surface 32*a* of the cover 32. The projections 55 are held in contact with a cover holding spring 53, which will be explained later.

Referring to FIG. 4, a shaft support portion 44 is defined in the lower surface 32*b* of the cover 32 at a position corresponding to the driven shaft 30 of the driven gear 27. The shaft support portion 44 is shaped identical to the shaft support portion 29 of the housing 21. Further, a groove 47 is defined in the lower surface 32*b* of the cover 32. The groove 47 has an annular shape defined around the shaft support portion 44, the central opening 41*a* of the suction port 41, and the central opening 42*a* of the discharge port 42. When the housing 21 is sealed by the cover 32, the groove 47 is located outward from the opening end of the accommodating chamber 23. A seal member 48, which has a similar annular shape, is fitted into the groove 47.

Figure 8:
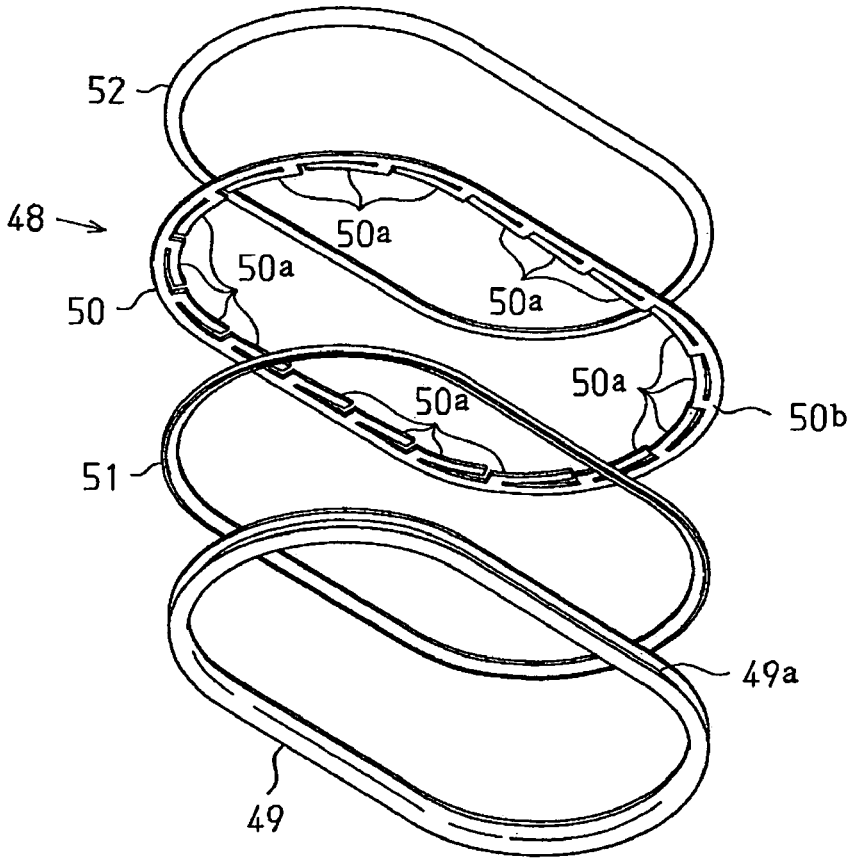
FIG. 8 is an exploded perspective view showing a seal member provided in the gear pump of FIG. 2.

As illustrated in FIG. 8, the seal member 48 includes a packing 49 formed of elastic material such as elastomer, a spring member 50 functioning as a second urging member, a first washer 51, and a second washer 52. The packing 49, the spring member 50, and the first and second washers 51, 52 are all formed in annular shapes.

Figure 9:
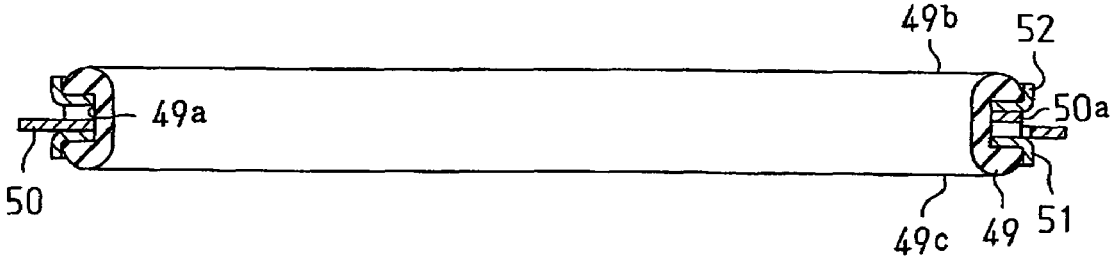
FIG. 9 is a cross-sectional view showing the seal member of FIG. 8.

With reference to FIGS. 8 and 9, an annular groove 49*a*is defined in an outer circumferential surface of the packing 49. The packing 49 thus has a substantially channel-like cross-sectional shape. As shown in FIG. 9, the washers 51, 52, which are shaped substantially identical to each other and each include a bent outer circumferential portion, are fitted into the annular groove 49*a*. An outer circumferential edge of the first washer 51 faces toward a lower end 49*c* of the packing 49 (i.e., downward as viewed in FIG. 9). An outer circumferential edge of the second washer 52 faces toward an upper end 49*b* of the packing 49 (i.e., upward as viewed in FIG. 9). The spring member 50 is fitted into the annular groove 49*a* such that the spring member 50 is clamped between the first washer 51 and the second washer 52. As shown in FIG. 8, the spring member 50 includes an annular portion 50*b* and a plurality of spring portions 50*a* extending from the annular portion 50*b*. Each of the spring portions 50*a* has a substantial L shape and includes a proximal portion extending inward from the annular portion 50*b* and a distal portion extending along the annular portion 50*b*. The distal portion of each spring portion 50*a*, which extends along the annular portion 50*b*, is slanted toward the distal end of the spring portion 50*a* in an upward direction of FIG. 8, or, in other words, in a direction approaching the second washer 52.

The first and second washers 51, 52 are urged by the spring member 50 in directions separating from each other. That is, the first washer 51 and the second washer 52 are urged toward the lower end 49*c* and the upper end 49*b* of the packing 49, respectively. The seal member 48 formed by the packing 49, the first and second washers 51, 52, and the spring member 50 is fitted into the groove 47 such that the upper end 49*b* opposes the bottom of the groove 47. When clamped between the cover 32 and the housing 21, the seal member 48 urges the cover 32 separately from the housing 21 by means of the urging force of the spring member 50.

As shown in FIG. 2, the cover holding spring 53 functioning as a first urging member is secured to the upper surface 32*a* of the cover 32. Referring to FIGS. 3 and 4, the cover holding spring 53 is a plate-like member having opposed side edges that are bent toward the housing 21. Two holes H3 are defined in the cover holding spring 53 and a corresponding one of the suction port 41 and the discharge port 42 is passed through each of the holes H3. Further, four spring portions 54 are formed in the cover holding spring 53. Each of the spring portions 54 is formed by a section of the cover holding spring 53 defined by a substantially U-shaped cutout, which is urged in a manner projecting not from the upper surface (one side surface) 53*a* but from the lower surface (the opposed side surface) 53*b* of the cover holding spring 53. Thus, when the cover holding spring 53 is secured to the cover 32, the spring portions 54 are urged upward by the corresponding projections 55 of the cover 32. As a result, each of the spring portions 54 urges the cover 32 toward the housing 21 through the corresponding one of the projections 55.

First through holes H1 are defined in the four corners of the cover 32 and second through holes H2 are defined in the four corners of the cover holding spring 53. A corresponding one of the four bolts P, which are passed through the corresponding bolt passing portions 21*d* of the housing 21, is passed through each of the first through holes H1 and the associated one of the second through holes H2. A fastening member such as a nut (not shown) is fastened to each of the bolts P, which is passed through the first and second through holes H1, H2. This structure secures the cover 32 and the cover holding spring 53 to the housing 21.

Figure 7:
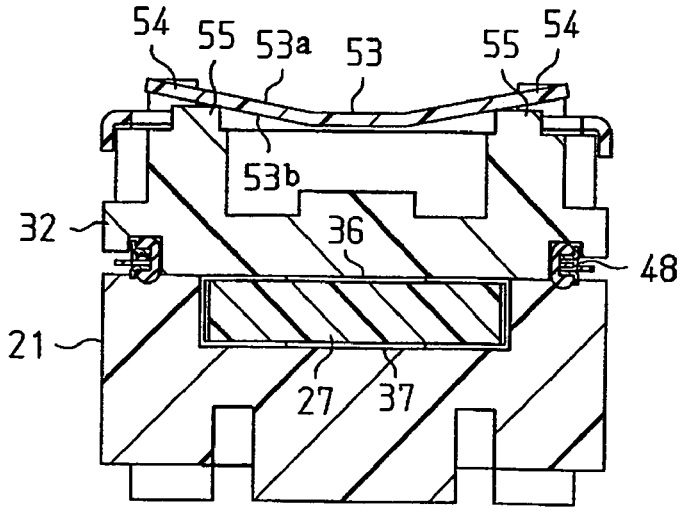
FIG. 7 is a lateral cross-sectional view showing the printer of FIG. 2.

When the cover 32 is secured to the housing 21, the annular projection 33 of the drive gear 26 is held in contact with the lower surface 32*b* of the cover 32, as shown in FIG. 6, while, in contrast, the upper surface 26*a* of the drive gear 26 located radially outward from the annular projection 33 is spaced from the cover 32. Similarly, the annular projection 34 projecting from the lower surface 26*b* of the drive gear 26 is held in contact with the bottom of the first accommodating portion 24, while, in contrast, the lower surface 26*b* of the drive gear 26 located radially outward from the annular projection 34 is spaced from the bottom of the first accommodating portion 24. Also, the annular projection 36 projecting from the upper surface 27*a* of the driven gear 27 is held in contact with the lower surface 32*b* of the cover 32, while, in contrast, the upper surface 27*a* of the driven gear 27 located radially outward from the projection 36 is spaced from the cover 32. Further, the annular projection 37 projecting from the lower surface 27*b* of the driven gear 27 is held in contact with the bottom of the accommodating portion 25, while, in contact, the lower surface 27*b* of the driven gear 27 located radially outward from the projection 37 is spaced from the bottom of the accommodating portion 25. In FIGS. 6 and 7, the gap size between the upper surface 26*a* of the drive gear 26 or the upper surface 27*a* of the driven gear 27 and the housing 21 and the gap size between the lower surface 26*b* of the drive gear 26 or the lower surface 27*b* of the driven gear 27 and the cover 32 are illustrated as exaggerated for the purposes of illustration. However, each of the gap sizes is not greater than 50 μm, making it difficult for the ink to flow through the gaps.

As has been described, the drive gear 26 and the driven gear 27 are held in contact with the cover 32 by means of the associated annular projections 33, 36 and with the housing 21 by means of the associated annular projections 34, 37. Therefore, when the drive gear 26 and the driven gear 27 are rotated, the annular projections 33, 36 slide along the cover 32 and the annular projections 34, 37 slide along the housing 21. However, the upper surface 26*a* and the lower surface 26*b* of the drive gear 26 and the upper surface 27*a* and the lower surface 27*b* of the driven gear 27 are spaced from the cover 32 and the housing 21. The annular projections 33, 34 are each formed around the shaft hole 35, or at a portion of the drive gear 26 spaced from the rotational axis of the drive gear 26 by a relatively short interval. The annular projections 36, 37 are each formed around the shaft hole 38, or at a portion of the driven gear 27 spaced from the rotational axis of the driven gear 27 by a relatively short interval. Such arrangement reduces friction load.

As illustrated in FIG. 7, the cover 32 is pressed against the housing 21 by the cover holding spring 53. The seal member 48 secured to the cover 32 is clamped between the cover 32 and the housing 21 and thus seals the accommodating chamber 23 tightly. The seal member 48 urges the cover 32 toward the cover holding spring 53 by the urging force of the spring member 50. That is, the cover 32 is urged toward the housing 21 by the force generated through equilibrium between the urging force of the cover holding spring 53 and the urging force of the seal member 48. This prevents the cover holding spring 53 from pressing the drive gear 26 and the driven gear 27 against the cover 32 and the housing 21 by excessive force.

The operation of the gear pump 20 will now be explained by an example in which cleaning of the recording head 8 is carried out. In head cleaning, the cap holder 11 is actuated such that the nozzle forming surface of the recording head 8 closes the cap member 12. If a non-illustrated control unit of the printer 1 generates a prescribed timing drive instruction, the drive motor is actuated such that the drive shaft 22 is rotated in the direction indicted by arrow r1. The driven gear 27 meshed with the drive gear 26 is thus rotated in the direction indicated by arrow r2. In this state, the drive gear 26 and the driven gear 27 are pressed against the housing 21 through the annular projections 33, 34, 36, 37 by the force generated through equilibrium between the urging force of the cover holding spring 53 and the urging force of the seal member 48. Further, the annular projection 33 and the annular projection 36 projecting respectively from the upper surface 26*a* of the drive gear 26 and from the upper surface 27*a* of the driven gear 27 are sliding along the cover 32. The remaining portion of the upper surface 26*a* other than the projection 33 and the remaining portion of the upper surface 27*a* other than the projection 36 are held as spaced from the cover 32. Further, the annular projection 34 and the annular projection 37 projecting respectively from the lower surface 26*b* of the drive gear 26 and from the lower surface 27*b* of the driven gear 27 are sliding along the housing 21. In this state, the remaining portion of the lower surface 26*b* other than the projection 34 and the remaining portion of the lower surface 27*b* other than the projection 37 are held as spaced from the housing 21.

When the drive gear 26 and the driven gear 27 are rotated, the ink that has been temporarily retained in the suction chamber 39 is sent to the space defined by the grooves of the drive gear 26 and the driven gear 27 and the inner walls of the accommodating chamber 23. The ink then flows to the discharge chamber 40 and is eventually discharged into the discharge chamber 40. The pressure in the suction chamber 39 thus becomes relatively low. As a result, the ink retained in the cap member 12 flows into the suction chamber 39 through the tube 13 for raising the pressure in the suction chamber 39. At this stage, the pressure in the suction chamber 39 is lower than the pressure in the discharge chamber 40. However, the gap size between the upper surfaces 26*a*, 27*a* and the cover 32 and the gap size between the lower surfaces 26*b*, 27*b* and the housing 21 are not greater than 50 μm. Therefore, only a slight amount of ink is returned from the discharge chamber 40 to the suction chamber 39 through these gaps. The suction performance is thus not hampered greatly by the returned ink. Further, the gears are ejection-molded such that the shape of a surface of the mold is transferred to the product for forming each of the annular projections 33, 34, 36, 37. Each projection 33, 34, 36, 37 is thus shaped with relatively high accuracy.

After being introduced from the cap member 12 to the suction chamber 39 and then to the discharge chamber 40 by the drive gear 26 and the driven gear 27, the ink is discharged to the waste ink reservoir 16 through the tube 15. This draws the retained ink and air from the cap member 12 such that the pressure in the cap member 12 becomes negative. The ink and air bubbles are thus drawn from the nozzle of the recording head 8.

The illustrated embodiment has the following advantages.

(1) In the illustrated embodiment, the annular projection 33 and the annular projection 36 are projected from the upper surface 26*a* of the drive gear 26 and the upper surface 27*a* of the driven gear 27, respectively, for contacting the cover 32. The upper surfaces 26*a*, 27*a* are maintained as spaced from the cover 32. Similarly, the annular projection 34 and the annular projection 37 are projected from the lower surface 26*b* of the drive gear 26 and the lower surface 27*b* of the driven gear 27, respectively, for contacting the bottom of the accommodating chamber 23 (the housing 21). The lower surfaces 26*b*, 27*b* are maintained as spaced from the housing 21. Such arrangement decreases the area of the portion of each of the drive gear 26 and the driven gear 27 sliding along the cover 32 or the housing 21. As a result, load is decreased when the drive gear 26 and the driven gear 27 are rotated.

(2) In the illustrated embodiment, each of the annular projections 33, 34, 36, 37 is arranged at the substantial center of the corresponding one of the drive gear 26 and the driven gear 27. More specifically, the interval between each projection 33, 34, 36, 37 and the rotational axis of the corresponding one of the drive gear 26 and the driven gear 27 is relatively short. This structure decreases generation of the viscous load torque.

(3) In the illustrated embodiment, the cover holding spring 53 for urging the cover 32 toward the housing 21 is secured to the upper surface 32*a* of the cover 32. Also, the spring member 50 for urging the cover 32 in a direction opposed to the housing 21 is provided in the seal member 48, which is fitted into the lower surface 32*b* of the cover 32. The cover 32 is thus pressed against the housing 21 by the force generated through equilibrium between the urging force of the cover holding spring 53 and the urging force of the spring member 50. Accordingly, the drive gear 26 and the driven gear 27 (more specifically, the annular projections 33, 34, 36, 37) are prevented from being pressed against the cover 32 and the housing 21 excessively. This reduces the friction force generated by the drive gear 26 or the driven gear 27 with respect to the cover 32 or the housing 21. Further, even if the packing is deteriorated due to long term use, the urging force is reliably generated by the spring member 50, such that the accommodating chamber 23 is maintained as sealed for a relatively long time.

The illustrated embodiment may be modified as follows.

In the illustrated embodiment, the spring member 50, which functions as the second urging member provided in the seal member 48, has a shape with a number of substantially L-shaped spring portions 50*a* arranged along the inner side of the annular portion 50*b*. However, instead of the spring member 50, a compression spring or an elastic member formed of elastomer may be employed as the second urging member.

In the illustrated embodiment, the first washer 51 and the second washer 52 are provided in the seal member 48. However, as long as the urging force of the spring member 50 acts uniformly on the cover 32 and the housing 21, the first and second washers 51, 52 may be omitted.

In the illustrated embodiment, each of the spring portions 54, which are formed in the cover holding spring 53, functions as the first urging member. However, a compression spring or the like for pressing the cover 32 may function as the first urging member, instead of the spring portions 54.

Figures 10A, 10B, 10C:
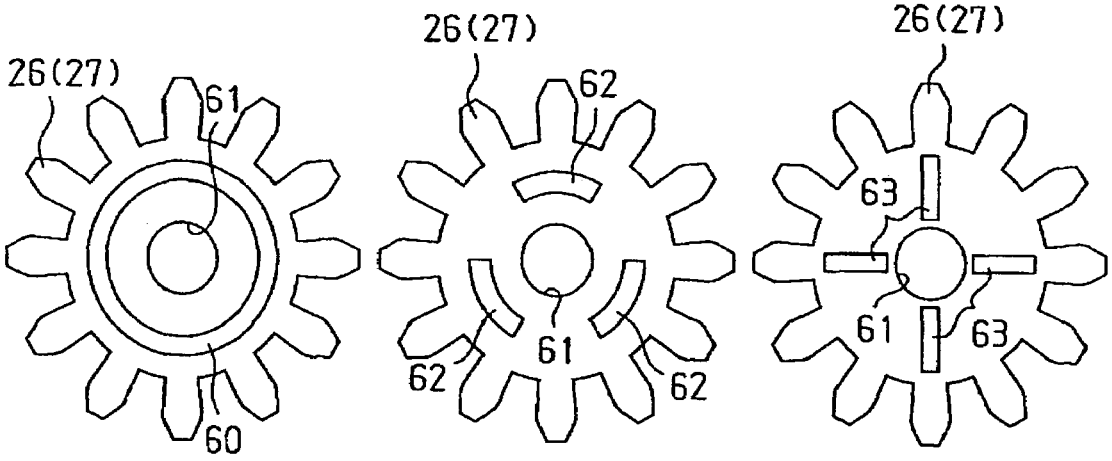
FIGS. 10(*a*) to 10(*c*) are plan views each showing a gear of a gear pump according to another embodiment of the present invention.
Figure 11:
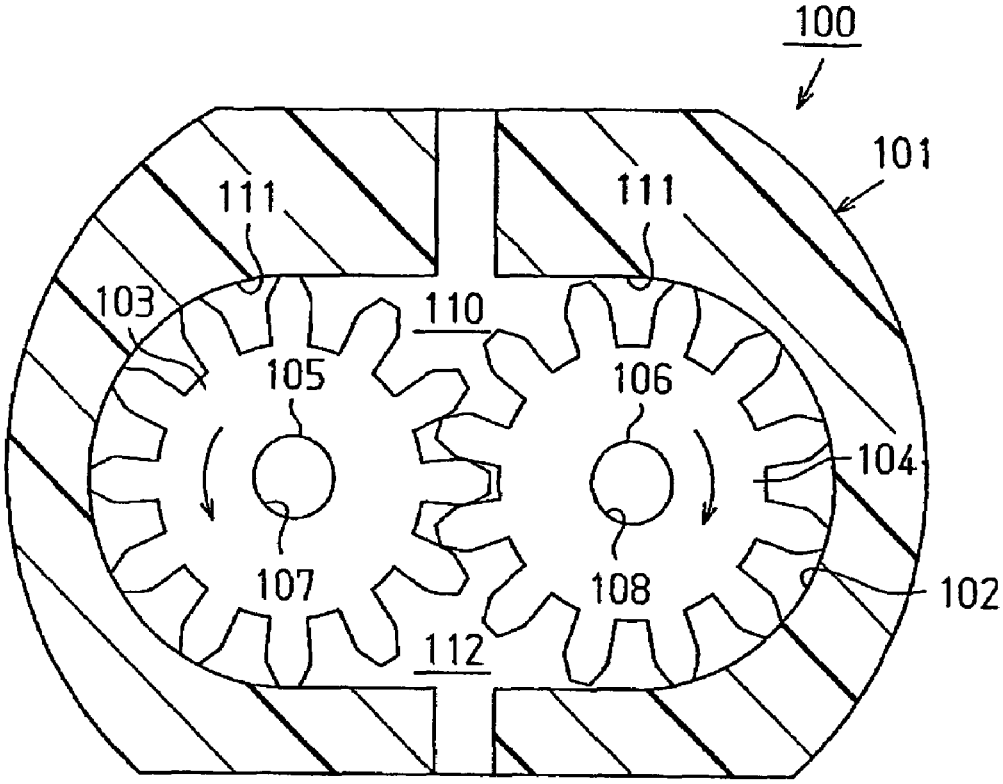
Fig. 11(Prior Art)
FIG. 11 is a plan view showing a conventional gear pump.

In the illustrated embodiment, the annular projections 33, 34 formed around the shaft hole 35 of the drive gear 26 and the annular projections 36, 37 formed around the shaft hole 38 of the driven gear 27 each function as a projection contacting the housing 21 or the cover 32. However, as shown in FIG. 10(*a*), an annular projection 60 that is formed not immediately around a shaft hole 61 but at a position spaced outward from the shaft hole 61 at a predetermined interval may function as the projection. Alternatively, referring to FIG. 10(*b*), a plurality of projecting pieces 62 that are aligned at predetermined angular intervals about the shaft hole 61 may function as the projections. Alternatively, as illustrated in FIG. 10(*c*), a plurality of projecting pieces 63 that extend radially from the shaft hole 61 may function as the projections. In other words, any suitable configuration may be selected as long as the configuration decreases the area of the sliding portion with respect to the housing 21 or the cover 32 and thus reduces the viscous load. In order to lower the friction load, it is preferable that the interval between the rotational axis of the gear and the projection is minimized.

In the illustrated embodiment, the gear pump 20 of FIG. 2 is installed in the printer 1 in which the ink cartridge 10 is not mounted on the carriage 5, or a so-called off-carriage type printer. However, the gear pump 20 may be installed in a printer having an ink cartridge mounted on a carriage. Also, the gear pump 20 may be installed in different apparatuses other than the liquid ejection apparatus.

The present invention may be embodied as a different liquid ejection apparatus other than the printer 1. That is, the present invention may be embodied as, for example, a printing apparatus such as a fax and a copier or a liquid ejection apparatus ejecting a different liquid (fluid) other than ink. The liquid ejection apparatus ejecting a different liquid may be a liquid ejection apparatus ejecting a liquid such as an electrode material or color material used in the manufacture of liquid crystal displays, EL displays, and surface emitting displays, or a liquid ejection apparatus ejecting a biological organic substance used in the manufacture of bio chips, or a sample ejection apparatus serving as a precision pipette.

Although the embodiments of the present invention has been explained in connection with the attached drawings, the invention is not restricted to the above description but may be modified within the scope and equivalence of the appended claims.

The invention claimed is:

1. A gear pump comprising:

a housing defining an accommodating chamber;

a seal plate for sealing the accommodating chamber, the seal plate including a first side surface and a second side surface;

a drive gear and a driven gear received in the accommodating chamber;

a first urging member formed at the first side surface of the seal plate, the first urging member urging the seal plate toward the housing;

a second urging member deployed between the seal plate and the housing, the second urging member urging the seal plate in a direction opposed to the urging direction of the first urging member by an urging force smaller than the urging force of the first urging member; and an annular seal member provided at the second side surface of the seal plate to seal between a peripheral portion of the housing and a peripheral portion of the seal plate, wherein the second urging member is arranged in the seal member, the second urging member includes an annular portion extending concentric with the seal member and a plurality of spring portions extending form the annular portion, and each of the spring portions includes a distal portion extending along the annular portion and slanted in an axial direction of the annular portion.

2. The gear pump according to claim 1, wherein each of the drive gear and the driven gear has a side surface opposed to the seal plate, and wherein a projection projects from the side surface of the drive gear or the driven gear for contacting the seal plate.

3. The gear pump according to claim 2, wherein the projection is arranged in the vicinity of the rotational axis of the drive gear or the driven gear.

4. The gear pump according to claim 1, wherein each of the drive gear and the driven gear has a side surface opposed to the housing, and wherein a projection projects from the side surface of the drive gear or the driven gear for contacting the housing.

5. The gear pump according to claim 4, wherein the projection is arranged in the vicinity of the rotational axis of the drive gear or the driven gear.

6. The gear pump according to claim 1, wherein:

each of the drive gear and the driven gear has a first side surface opposed to the seal plate and a second side surface opposed to the housing;

a first projection projects from the first side surface of the drive gear or the driven gear for contacting the seal plate; and a second projection projects from the second side surface of the drive gear or the driven gear for contacting the housing.

7. The gear pump according to claim 6, wherein the first projection and the second projection are arranged in the vicinity of the rotational axis of the drive gear or the driven gear.

8. A liquid ejection apparatus comprising a gear pump, the gear pump including:

a housing defining an accommodating chamber;

a seal plate for sealing the accommodating chamber, the seal plate including a first side surface and a second side surface;

a drive gear and a driven gear received in the accommodating chamber;

a first urging member formed at the first side surface of the seal plate, the first urging member urging the seal plate toward the housing;

a second urging member deployed between the seal plate and the housing, the second urging member urging the seal plate in a direction opposed to the urging direction of the first urging member by an urging force smaller than the urging force of the first urging member; and an annular seal member provided at the second side surface of the seal plate to seal between a peripheral portion of the housing and a peripheral portion of the seal plate, wherein the second urging member is arranged in the seal member, the second urging member includes an annular portion extending concentric with the seal member and a plurality of spring portions extending from the annular portion, and each of the spring portions includes a distal portion extending along the annular portion and slanted in an axial direction of the annular portion.

* * * * *